US008567019B2

(12) United States Patent
Yamamoto et al.

(10) Patent No.: US 8,567,019 B2
(45) Date of Patent: Oct. 29, 2013

(54) SEMI-AUTOMATIC SLIDER

(75) Inventors: Kentaro Yamamoto, Macon, GA (US); Hisashi Yoneshima, Toyama (JP); Shigeyoshi Takazawa, Macon, GA (US)

(73) Assignee: YKK Corporation of America, Marietta, GA (US)

( * ) Notice: Subject to any disclaimer, the term of this patent is extended or adjusted under 35 U.S.C. 154(b) by 345 days.

(21) Appl. No.: 13/088,554

(22) Filed: Apr. 18, 2011

(65) Prior Publication Data

US 2012/0260469 A1 Oct. 18, 2012

(51) Int. Cl.
*A44B 19/30* (2006.01)

(52) U.S. Cl.
USPC ..... 24/419; 24/421

(58) Field of Classification Search
USPC ..... 24/418, 419, 420, 421, 424, 425, 436
See application file for complete search history.

(56) References Cited

U.S. PATENT DOCUMENTS

| | | | | |
|---|---|---|---|---|
| 2,477,439 | A * | 7/1949 | Carlile | 24/421 |
| 3,038,228 | A * | 6/1962 | Carlile et al. | 24/425 |
| 4,422,220 | A * | 12/1983 | Oda | 24/421 |
| 4,662,036 | A | 5/1987 | Fröhlich | |
| 4,768,263 | A * | 9/1988 | Fukuroi et al. | 24/418 |
| 5,896,628 | A * | 4/1999 | Oda | 24/421 |
| 6,497,017 | B2 * | 12/2002 | Yamagishi | 24/421 |
| 6,637,078 | B2 * | 10/2003 | Nagata et al. | 24/421 |
| 6,647,599 | B2 * | 11/2003 | Lin | 24/421 |
| 6,769,156 | B1 * | 8/2004 | Chen | 24/421 |
| 7,219,401 | B2 * | 5/2007 | Yamagishi et al. | 24/421 |
| 7,356,887 | B2 * | 4/2008 | Iwase et al. | 24/421 |
| 7,624,481 | B2 * | 12/2009 | Iwase et al. | 24/421 |
| 2004/0103502 | A1 * | 6/2004 | Chen et al. | 24/421 |

FOREIGN PATENT DOCUMENTS

| | | | |
|---|---|---|---|
| DE | 3342453 | A1 * | 6/1985 |
| EP | 1 662 929 | | 6/2006 |
| GB | 2 051 221 | | 1/1981 |
| KR | 92-263 | | 1/1992 |
| TW | 73501 | | 1/1986 |
| TW | 432948 | | 5/2001 |

OTHER PUBLICATIONS

Machine German to English translation of German document DE 3342453, translated from ESPACENET on Aug. 24, 2013.*

* cited by examiner

*Primary Examiner* — Robert J Sandy
*Assistant Examiner* — Louis Mercado
(74) *Attorney, Agent, or Firm* — Kilpatrick Townsend & Stockton LLP

(57) ABSTRACT

A semi-automatic slider assembly having a slider body, a lock pin, and a pull tab. When the pull tab is in a first orientation, the lock pin engages with elements of the tape and the slider assembly is in a locked configuration that prevents the slider assembly from moving along the tape. When the pull tab is in a second orientation, the lock pin does not engage with the elements of the tape and the slider assembly is in an unlocked configuration so that the assembly is permitted to move along the tape. The slider body has a recess for receiving a portion of the lock pin, and the lock pin has an opening that reduces interference when the pull tab is in the second orientation.

17 Claims, 25 Drawing Sheets

SEMI-AUTOMATIC SLIDER

RELATED FIELDS

Semi-automatic sliders having a locking feature.

BACKGROUND

A slider typically consists of a slider body and a pull tab. Many sliders, including the slider bodies, are made of metal. As is known, a slider cooperates with elements located on opposite sides of a tape to open and close a zipper. When the slider body is moved by pulling the pull tab, a generally Y-shaped channel located between a top wing and a bottom wing of the slider body meshes together rows of opposing elements of the tape. When slider body is moved in the opposite direction, the generally Y-shaped channel separates the rows of opposing elements.

To prevent the zipper from inadvertently opening or closing, some sliders include a locking feature. When the pull tab is in a particular orientation (for example, lowered so that it is approximately parallel with the tape), the lock engages the elements of the tape to prevent the slider from moving along the tape. When the pull tab is not in this particular orientation (for example, raised so that it is approximately perpendicular to the tape), the lock does not engage the elements of the tape and the slider is permitted to move along the tape. Sliders having this type of locking feature are sometimes referred to as "semi-automatic" sliders.

SUMMARY

In some versions, there is disclosed a slider assembly having a locked orientation and an unlocked orientation, the slider assembly comprising: (a) a slider body comprising a recess, a cavity, and a plurality of stoppers positioned along a top of the slider body, the plurality of stoppers each comprising a notch and an extension that extends upwardly from a top surface of the stopper and that extends beyond a pedestal of the stopper; (b) a pull tab pivotably connected to the slider body, the pull tab having a first orientation and a second orientation; and (c) a lock pin positioned with respect to the top of the slider body, the lock pin comprising: (i) a lower portion comprising an apex section and a nail portion extending from the apex section, wherein the nail portion extends through the cavity of the slider body and into a channel of the slider body when the slider assembly is in the locked orientation and wherein the nail portion does not project into the channel of the slider body when the slider assembly is in the unlocked orientation; (ii) an upper portion having left and right sides that contact the plurality of stoppers and that partially define an opening positioned above the apex section of the lower portion, the upper portion also having a rear surface that extends downwardly from the left and right sides and that contacts the top of the slider body, wherein the apex section of the lower portion at least partially extends through the opening when the slider assembly is in the locked orientation; (iii) a plurality of engagement portions that extend from the upper portion generally transverse to the left and right sides and that engage with the notches of the plurality of stoppers; and (iv) a bent portion joining the upper portion with the lower portion, wherein at least a part of the bent portion is received within the recess of the slider body, wherein movement of the pull tab from the first orientation to the second orientation moves the slider assembly from the locked orientation to the unlocked orientation.

Also disclosed is a slider assembly wherein the pull tab further comprises a protrusion that cooperates with the lock pin when the pull tab is in the second orientation.

Also disclosed is a slider assembly wherein edges of the right and left sides of the upper portion of the lock pin abut the extensions of the plurality of stoppers.

Also disclosed is a slider assembly wherein the slider body further comprises a wall that surrounds the recess.

Also disclosed is a slider assembly wherein the slider body is made of plastic.

Also disclosed is a slider assembly wherein a portion of the pull tab is positioned between the top of the slider body and the lower portion of the lock pin.

Also disclosed is a slider assembly wherein the lock pin extends generally perpendicular to the apex section of the upper portion when the slider assembly is in the locked position.

Also disclosed is a slider assembly wherein the plurality of stoppers comprises four stoppers.

Also disclosed is a slider assembly wherein the lock pin is snap fit onto the slider body.

Also disclosed is a slider assembly wherein the bent portion of the lock pin is generally U-shaped.

Also disclosed is a slider assembly wherein the engagement portions of the lock pin are positioned below the opening.

Also disclosed is a lock pin configured to engage with a slider body, the lock pin comprising: (i) a lower portion comprising an apex section and a nail portion extending from the apex section, wherein the nail portion is configured to extend through a cavity of the slider body and into a channel of the slider body; (ii) an upper portion having left and right sides and a rear surface that partially define an opening positioned above the apex section of the lower portion, the rear surface extending downwardly from the left and right sides, and the upper portion also having a plurality of engagement portions that extend generally transverse to the left and right sides, that are positioned below the opening, and that are configured to engage with a plurality of notches of the slider body; and (iii) a generally U-shaped bent portion joining the upper portion with the lower portion, wherein at least a part of the bent portion is configured to be received within a recess of the slider body.

Also disclosed is a lock pin wherein the bent portion projects outwardly from a front of the lower portion.

Also disclosed is a lock pin wherein the plurality of engagement portions comprises four engagement portions.

Also disclosed is a lock pin wherein the apex section is generally planar.

Also disclosed is a slider assembly having a locked orientation and an unlocked orientation, the slider assembly comprising: (a) a slider body comprising a top wing and a bottom wing that are separated from one another by a channel: (i) a plurality of stoppers positioned along the top wing of the slider body, each of the plurality of stoppers comprising a pedestal and an extension that extends upwardly from a top surface of the stopper and that extends beyond the pedestal of the stopper and that includes a notch; (ii) a recess formed within a front of the slider body; and (iii) a cavity; and (b) a lock pin positioned with respect to the top wing of the slider body, the lock pin comprising: (i) a lower portion having an apex section and a nail portion extending from the surface, wherein the nail portion extends through the cavity of the slider body and projects into the channel of the slider body when the slider assembly is in the locked orientation and wherein the nail portion lifts with respect to the cavity when the slider assembly is in the unlocked orientation so that it does not project into the channel; (ii) an upper portion having left and right sides that partially define an opening positioned above the apex section of the lower portion, wherein the left and right sides contact the plurality of stoppers of the slider body and wherein the surface is at least partially received within the opening when the slider assembly is in the locked orientation; (iii) a plurality of engagement portions that extend from the upper portion transversely to the left and right sides, wherein the plurality of engagement portions are positioned below the opening and engage with the notches of the plurality of stoppers; and (iv) a generally U-shaped bent portion joining the upper portion with the lower portion, wherein the bent portion projects outwardly from a front of the lower portion and wherein at least a part of the bent portion is received within the recess of the slider body.

Also disclosed is a slider assembly wherein an edge of each of the left and right sides of the lock pin abuts the extension of the plurality of stoppers.

Also disclosed is a slider assembly wherein the lock pin further comprises a rear surface that extends downwardly from the left and right sides of the upper portion and that contacts the top wing of the slider body.

Also disclosed is a slider assembly further comprising a pull tab that is retained within the assembly by the lock pin.

Applicants do not wish to be bound by the forgoing or any other understanding of how their invention or any of the prior art works.

BRIEF DESCRIPTION OF THE DRAWINGS

A full and enabling disclosure including the best mode of practicing the appended claims and directed to one of ordinary skill in the art is set forth more particularly in the remainder of the specification. The specification makes reference to the following appended figures, in which use of like reference numerals in different figures is intended to illustrate like or analogous components.

DETAILED DESCRIPTION

Figure 22:
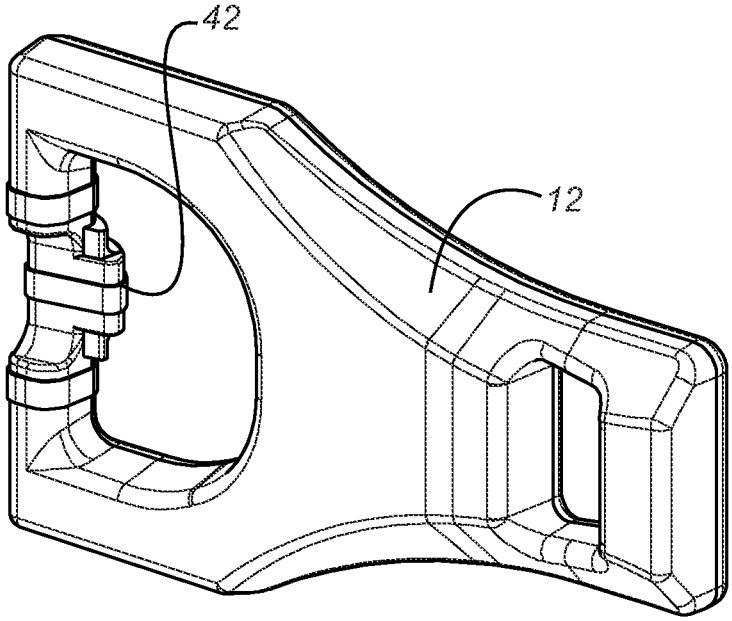
FIG. 22 is a perspective view of a pull tab of the slider assembly of FIG. 1.
Figure 23:
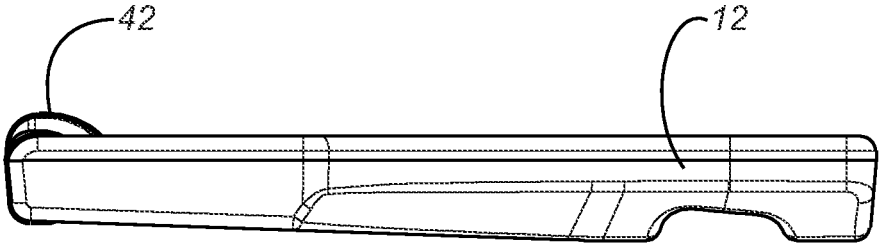
FIG. 23 is a side view of the pull tab of FIG. 22.
Figure 24:
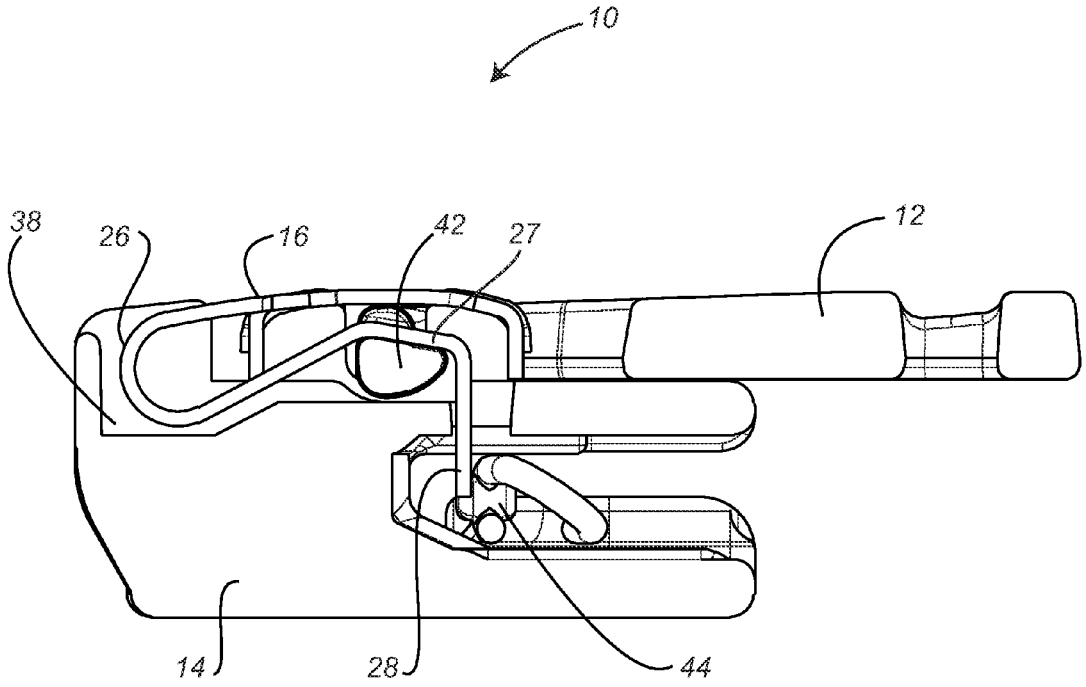
FIG. 24 is a cross sectional view of the slider assembly of FIG. 1, shown in the locked orientation and engaging an element of a tape.
Figure 25:
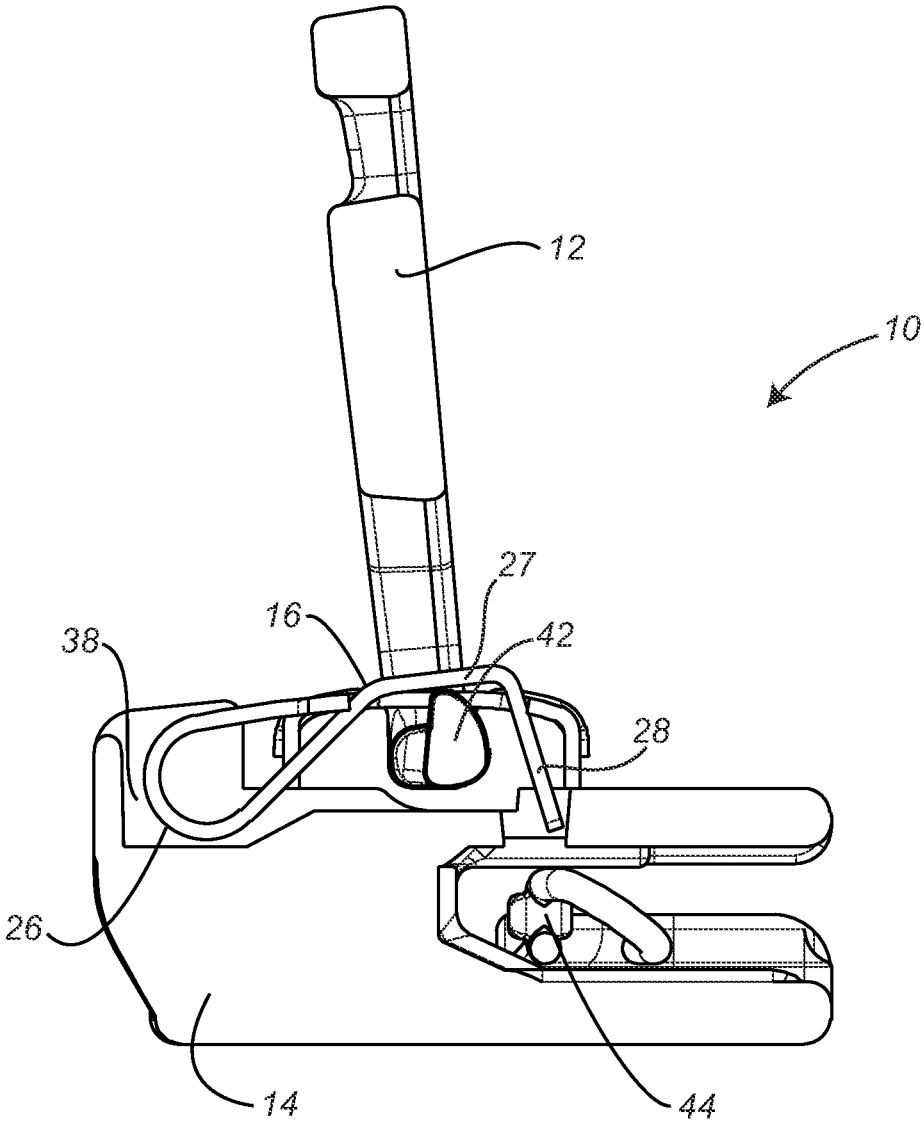
FIG. 25 is a cross sectional view of the slider assembly of FIG. 1, shown in the unlocked orientation and not engaging an element of a tape.

FIGS. 1-11 show a slider assembly 10 that includes a pull tab 12 (shown in isolation in FIGS. 22-23), a slider body 14 (shown in isolation in FIGS. 12-15), and a lock pin 16 (shown in isolation in FIGS. 16-21). FIGS. 24-25 show the interaction of the slider assembly 10 with an element 44 of a tape. In some versions, lock pin is made of metal, such as stainless steel or other suitable material that is configured to return to its original shape or position after flexing or bending. Slider body 14 and pull tab 12 can be any suitable lightweight, relatively soft durable material such as plastic. In some versions, slider body 14 and/or pull tab 12 are made of synthetic resin, such as polyamides, polyvinyl chloride, Polybutylene terephthalate or any other suitable engineered polymer. In other versions, pull tab 12 is formed of metal. Slider assembly 10 can cooperate with either metal or plastic elements of a tape.

As is known, a slider assembly cooperates with elements (such as element 44 shown in FIGS. 24-25) located on opposite sides of a tape to open and close a zipper. When the pull tab 12 is moved in one direction along the tape, thereby moving the slider assembly, a generally Y-shaped channel (such as channel 46) located between a top wing (such as wing 30 shown in FIG. 4) and a bottom wing (such as wing 32 shown in FIG. 4) of the slider body 14 meshes together rows of opposing elements of the tape. When the pull tab 12 is moved in the opposite direction, the generally Y-shaped channel separates the rows of opposing elements.

The lock pin 16 of slider assembly 10 is configured to cooperate with the elements 44 of the tape to selectively restrict movement of the slider assembly 10 along the tape, as will be described below. When the slider assembly 10 is in a locked orientation (FIG. 24), the lock pin 16 engages with the elements 44 and the slider assembly 10 is prevent from moving along the tape. When the slider assembly 10 is in an unlocked orientation (FIG. 25), the lock pin 16 does not engage with the elements 44 and slider assembly 10 is free to move along the tape.

As shown, for example, in FIGS. 16-21, lock pin 16 includes a nail portion 28 that extends in a generally vertical orientation from a lower portion 29. The width and height of nail portion 28 can vary. For example, if slider assembly 10 is configured to cooperate with a tape containing metal elements, nail portion 28 may be wider than the nail portion shown in the Figures.

Figure 17:
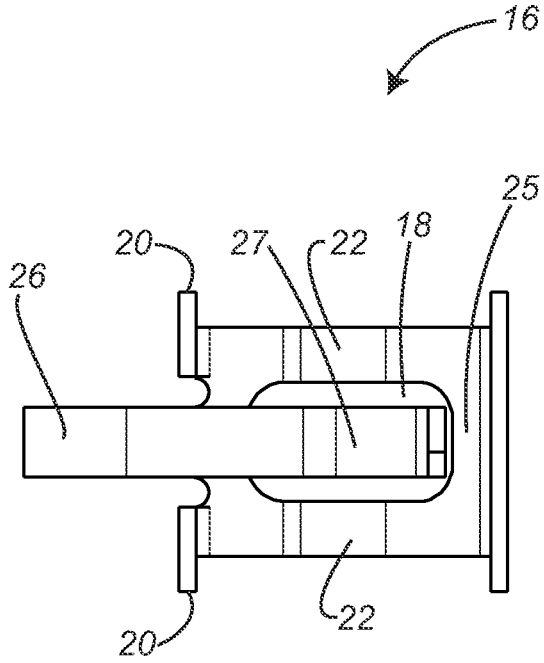
FIG. 17 is a bottom plan view of the lock pin of FIG. 16.
Figure 18:
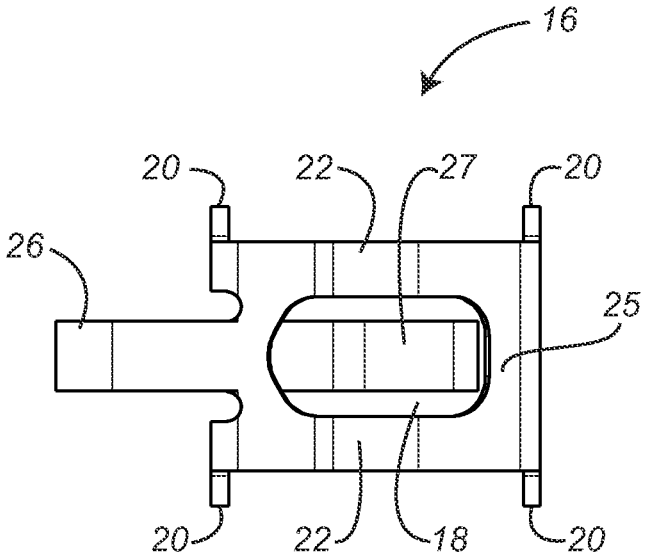
FIG. 18 is a top plan view of the lock pin of FIG. 16.
Figure 19:
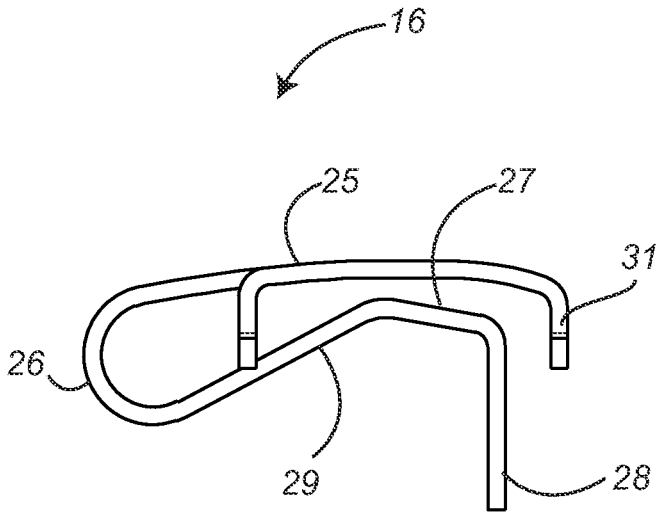
FIG. 19 is a side view of the lock pin of FIG. 16.
Figure 20:
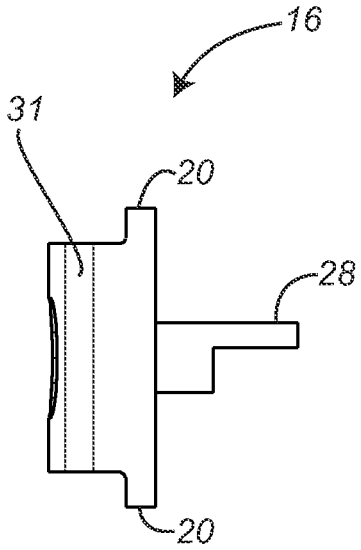
FIG. 20 is a rear view of the lock pin of FIG. 16.
Figure 21:
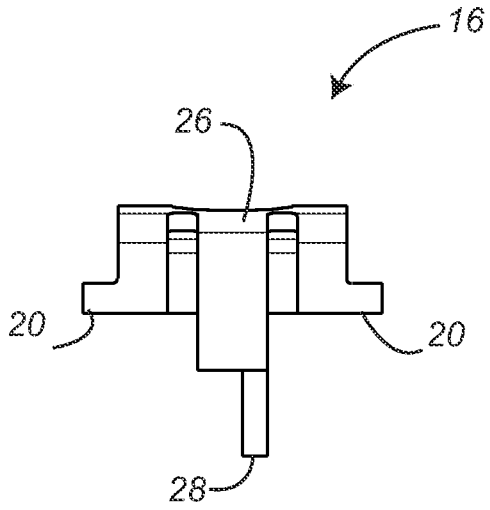
FIG. 21 is a front view of the lock pin of FIG. 16.

Lower portion 29 includes an apex section 27 (FIG. 19) located adjacent nail portion 28. Lock pin 16 also includes an upper portion 25. As shown in FIG. 17, upper portion 25 includes left and right sides 22 that are integrally connected with one another and that increase the strength of lock pin 16. An opening 18 (FIG. 16) is formed within upper portion 25, such opening partially defined by left and right sides 22. Opening 18 is positioned directly above the apex section 27 of the lower portion 29. Engagement portions 20 extend from front and rear ends of the upper portion 25, as shown in FIG.

16, and are configured to engage with stoppers 34 on the slider body 14 (described below). As shown, engagement portions 20 extend transverse to the left and right sides 22. Lock pin 16 also includes a rear surface 31 that extends down from left and right sides 22. Two of the engagement portions 20 project outwardly from rear surface 31.

Lock pin 16 also includes a generally U-shaped bent portion 26 that connects upper portion 25 with lower portion 29. In some versions, bent portion is curved over an angle of approximately 180 degrees. Lock pin 16 is a single piece, which streamlines the assembly process.

Figure 7:
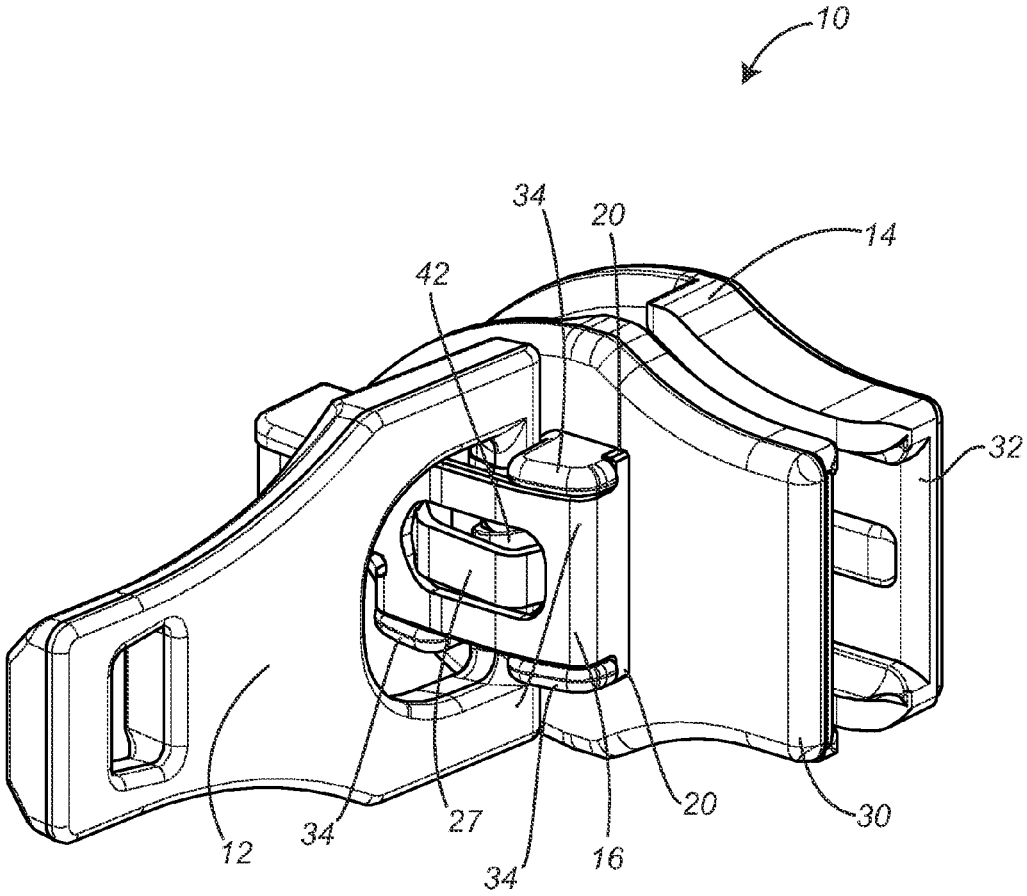
FIG. 7 is top perspective view of the slider assembly of FIG. 6.
Figure 8:
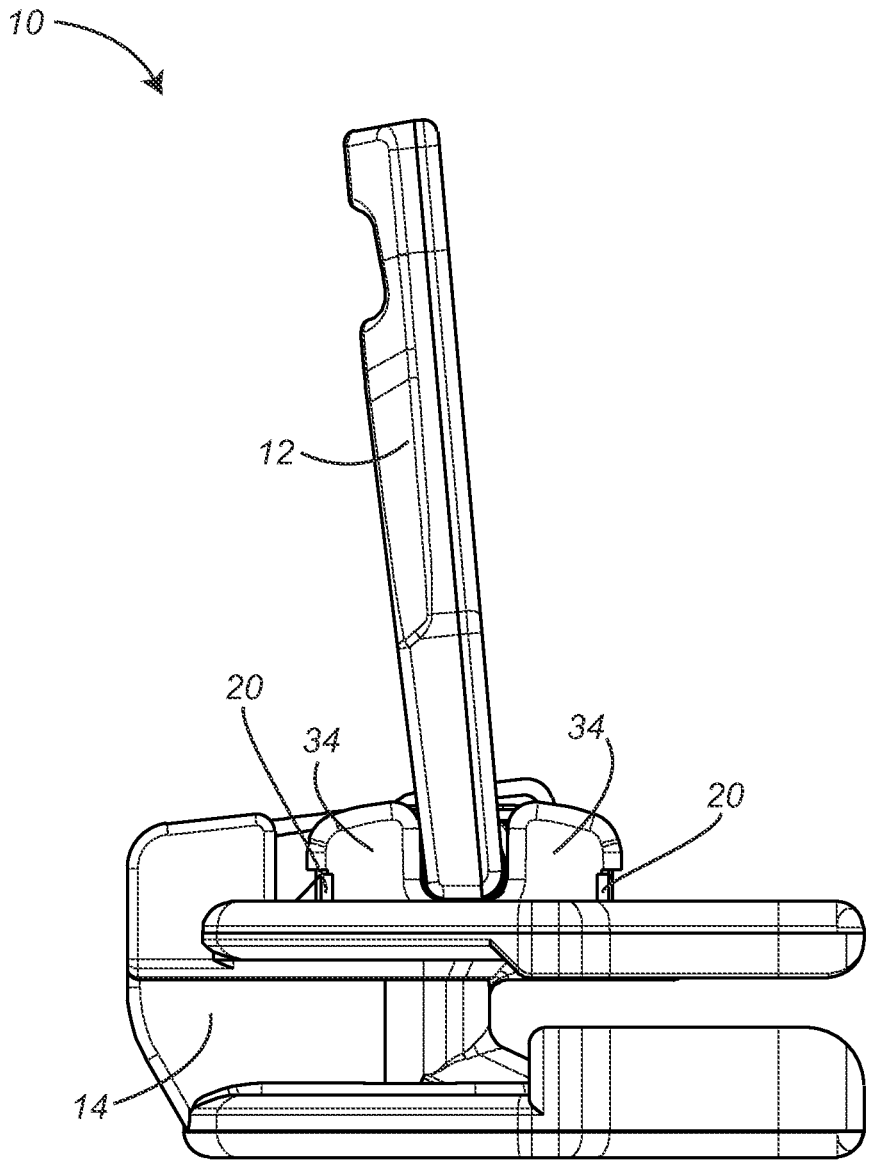
FIG. 8 is a side plan view of the slider assembly of FIG. 6.
Figure 9:
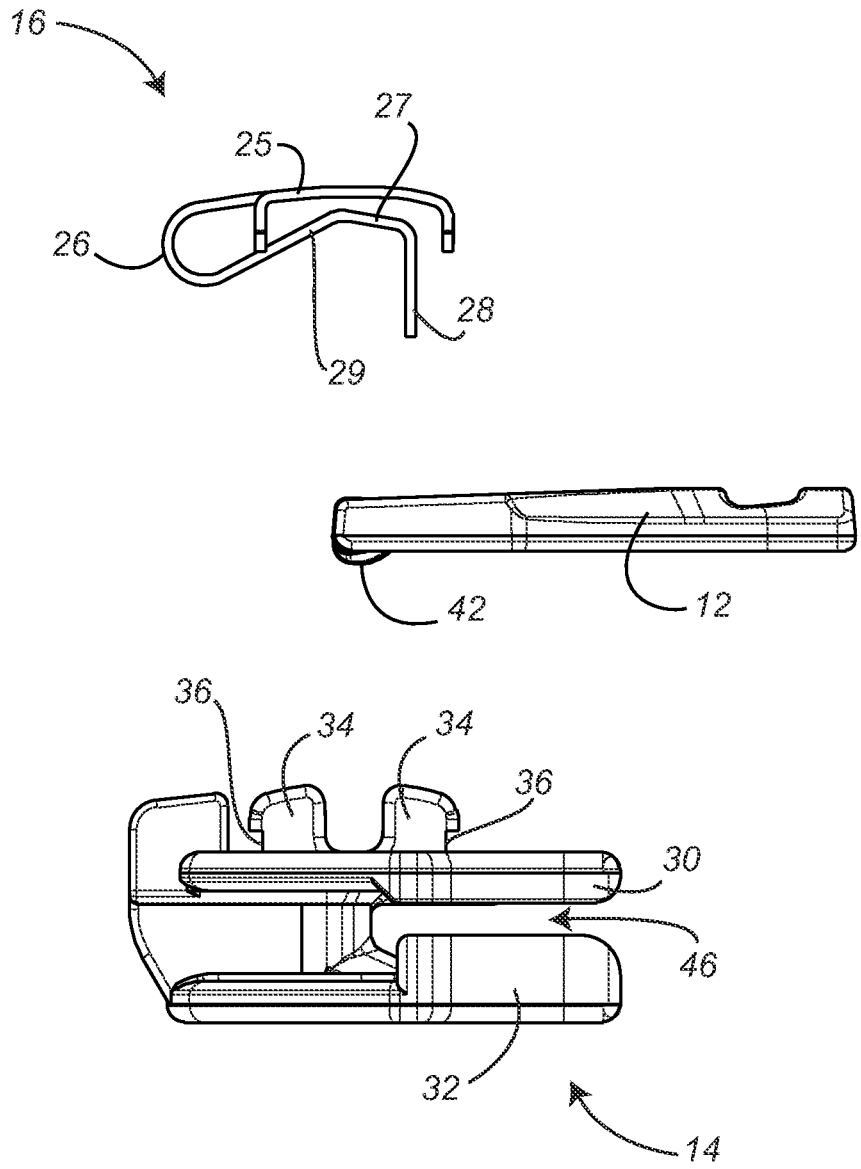
FIG. 9 is an exploded side view of the slider assembly of FIG. 3.
Figure 10:
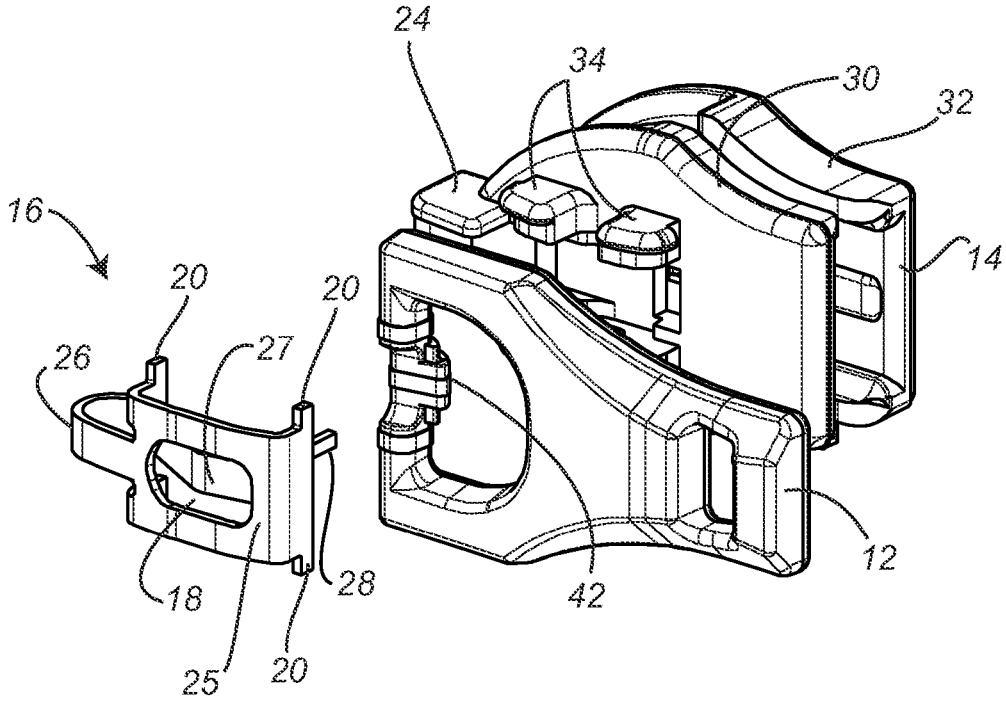
FIG. 10 is an exploded top view of the slider assembly of FIG. 1.
Figure 11:
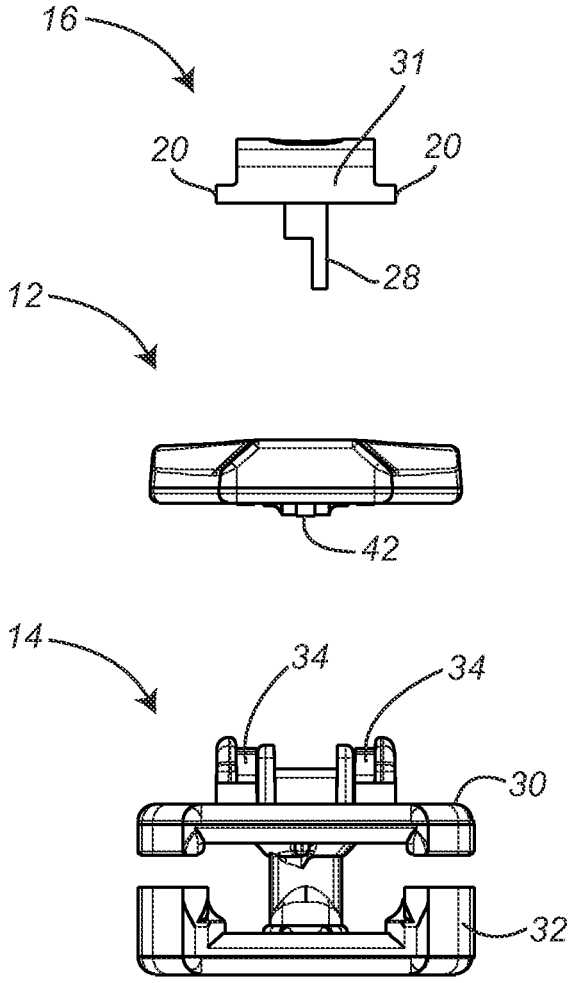
FIG. 11 is an exploded rear view of the slider assembly of FIG. 4.
Figure 13:
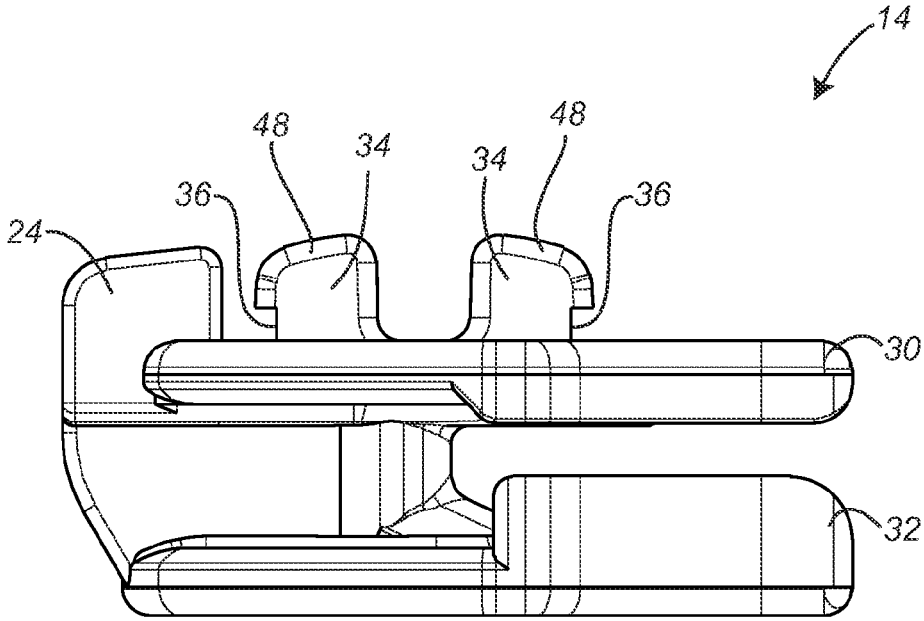
FIG. 13 is a side plan view of the slider body of FIG. 12.

Lock pin 16 is configured to engage with slider body 14. Specifically, lock pin 16 can be snap-fit onto a top of slider body 14 by way of engagement portions 20. As shown in FIG. 7, for example, engagement portions 20 engage with notches 36 of stoppers 34. FIG. 13 illustrates the positioning of notches 36 along stoppers 34, such notches 36 corresponding in shape and size to engagement portions 20. The engagement portions 20 extend from the lock pin 16 transversely to the direction of the slider body.

As shown, slider body 14 includes four stoppers 34, although more or less stoppers could be used. Stoppers 34 each include an extension 48 that extends upward from a top surface 52 of the stopper 34, and that also extends both forward and rearward beyond a pedestal 50 of the stopper 34.

Lock pin 16 is positioned with respect to slider body 14 so that the rear surface 31 of lock pin 16 contacts a top surface of the slider body 14 and so that each of the left and right sides 22 of the lock pin 16 is positioned along stoppers 34. Specifically, the bottom surface of left and right sides 22 of the lock pin 16 contacts the top surface 52 of the stoppers 34 and one of the edges of each of the left and right sides 22 abuts the extensions 48 of the stoppers.

After engaging with engagement portions 20 of lock pin 16, extensions 48 of the stoppers 34 help prevent the lock pin 16 from shifting back and forth, and also serve as a guide for the positioning of lock pin 16 in the desired position within slider body 14. The interaction between the engagement portions 20 and the notches 36 of the stoppers 34 increase the strength of the engagement of the lock pin with the slider body.

Figure 12:
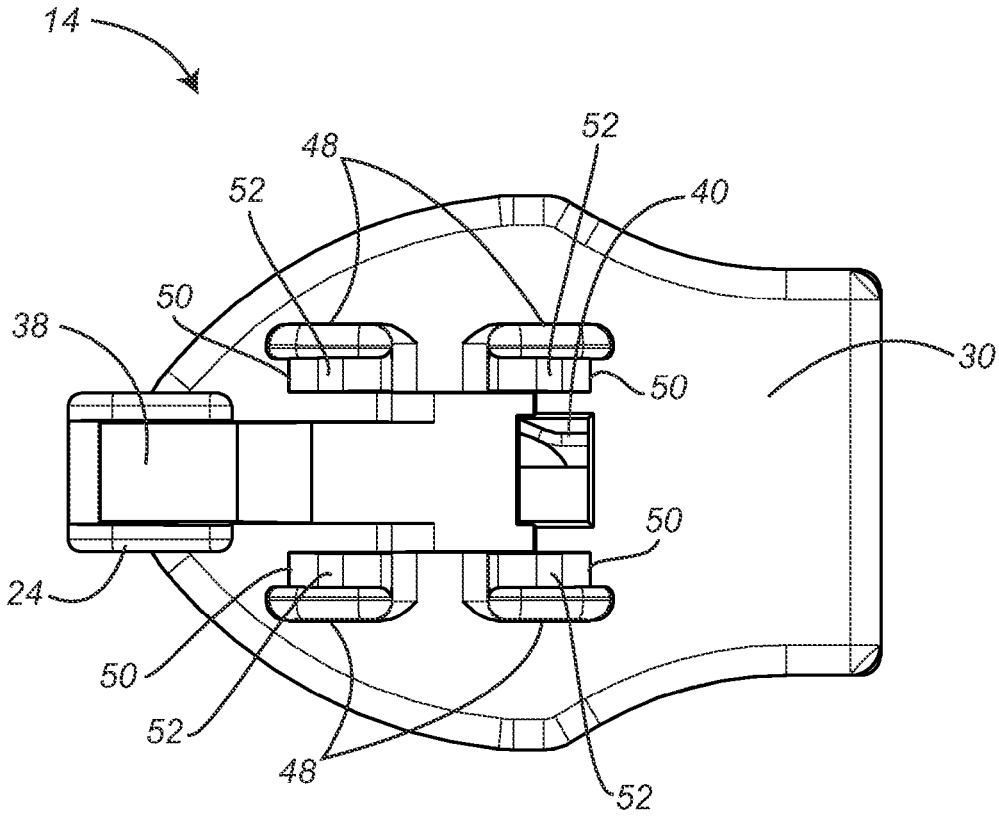
FIG. 12 is a top plan view of a slider body of the slider assembly of FIG. 1.
Figure 14:
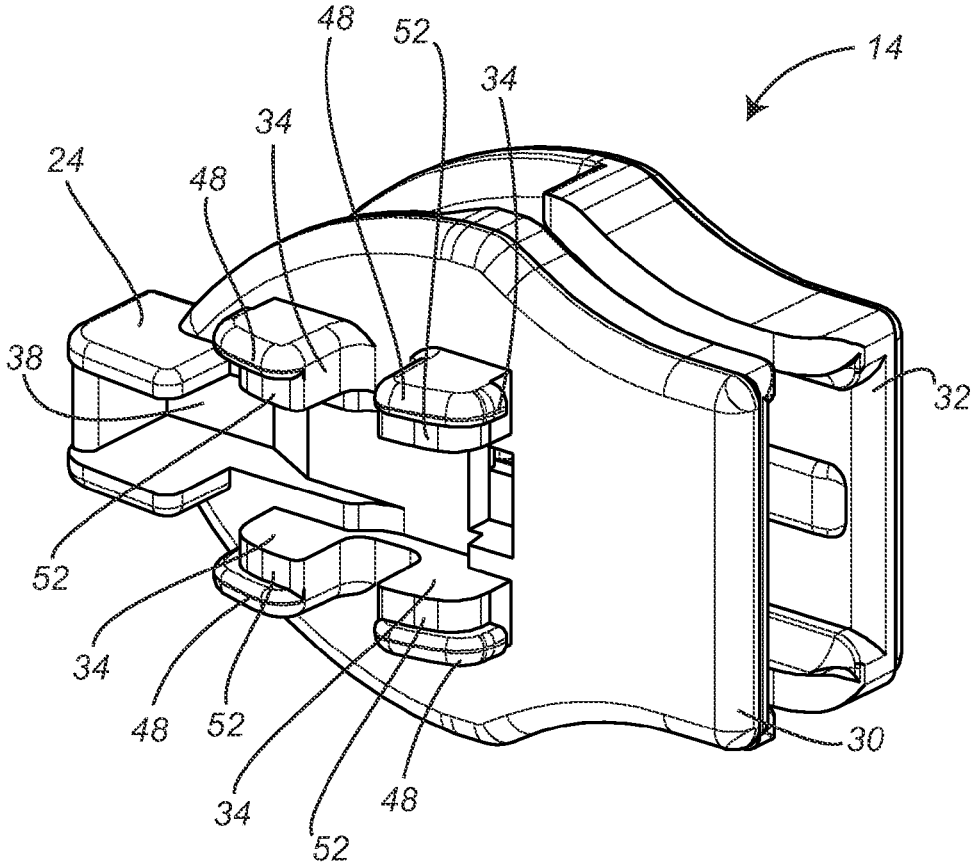
FIG. 14 is a top perspective view of the slider body of FIG. 12.
Figure 15:
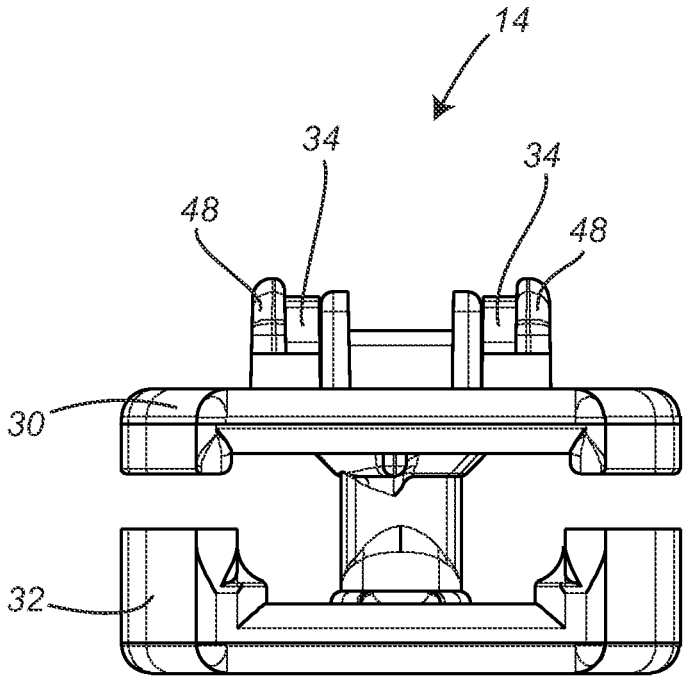
FIG. 15 is a rear view of the slider body of FIG. 12.
Figure 16:
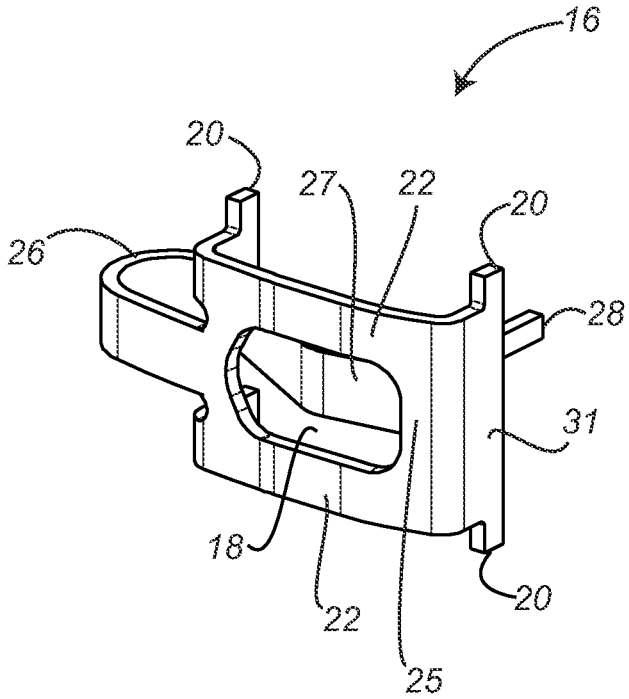
FIG. 16 is a top perspective view of a lock pin of the slider assembly of FIG. 1.

Slider body 14 includes a recess 38, shown for example in FIGS. 12 and 14, that is shaped and sized to receive at least a portion of bent portion 26 of lock pin 16. Positioning bent portion 26 within recess 38 allows the lock pin 16 to sit lower within the slider body and therefore helps reduce the height (sometimes referred to as the thickness) of the slider assembly 10. The recess 38 also reduces interference that would otherwise be caused by a protruding bent portion of the lock pin 16. Slider body 14 optionally includes a wall 24 that projects from the top of the slider body to surround the recess 38 and help protect the bent portion 26 of the lock pin 16.

Slider body 14 also includes a cavity 40 (FIG. 12), through which nail portion 28 of lock pin 16 extends when lock pin 16 is fitted with slider body 14 and when slider assembly 10 is in the locked configuration. When slider assembly 10 is in the locked configuration, nail portion 28 extends through the cavity 40 and into channel 46 of the slider body.

Pull tab 12 is pivotably attached to the slider body 14 in any suitable manner. Lock pin 16 is then attached to the slider body/pull tab structure using any suitable method. As mentioned above, lock pin 16 can be snap fit onto the pull tab and slider body structure. Because slider body is made of plastic or other suitable material, the snap-in method may be preferable to a standard clamping (via die casting) method that is sometimes employed with metal slider bodies. Once slider assembly 10 is assembled, the pull tab is relatively fixed in position such that the axis of pull does not shift back and forth or up and down.

Figure 1:
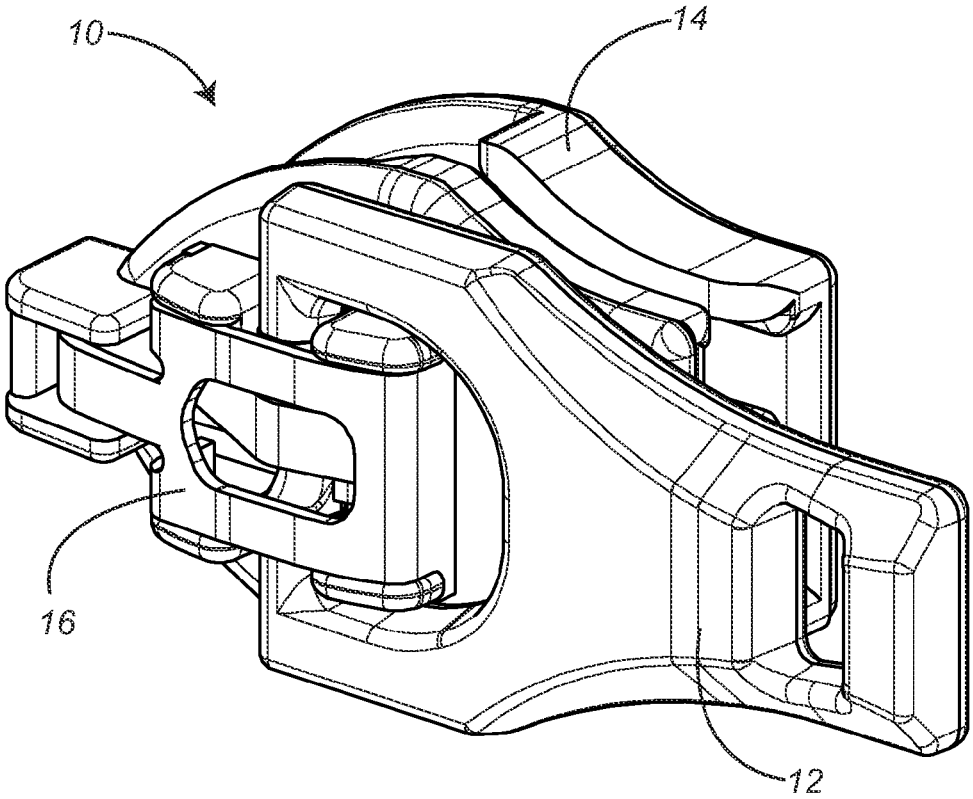
FIG. 1 is a top perspective view of a slider assembly according to one version.
Figure 2:
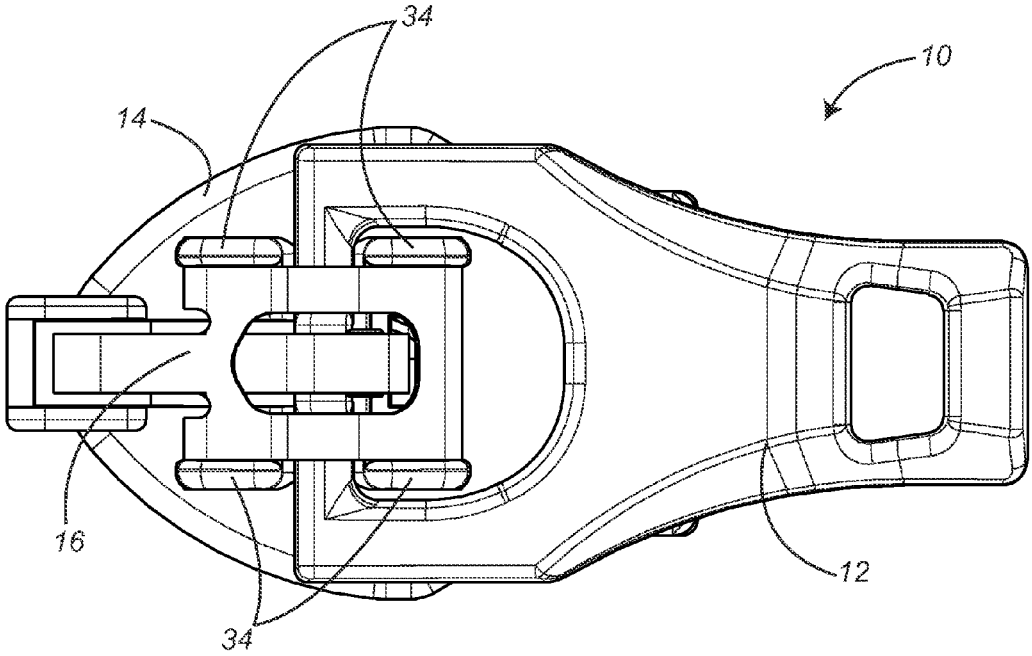
FIG. 2 is a top plan view of the slider assembly of FIG. 1.
Figure 3:
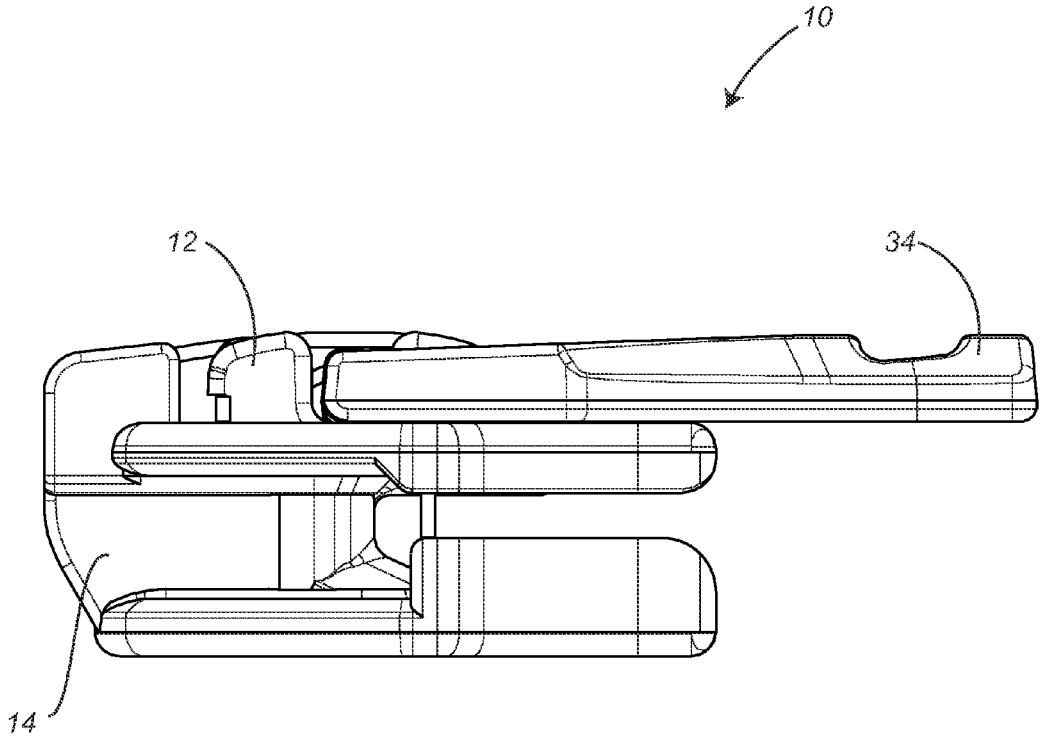
FIG. 3 is a side plan view of the slider assembly of FIG. 1.
Figure 4:
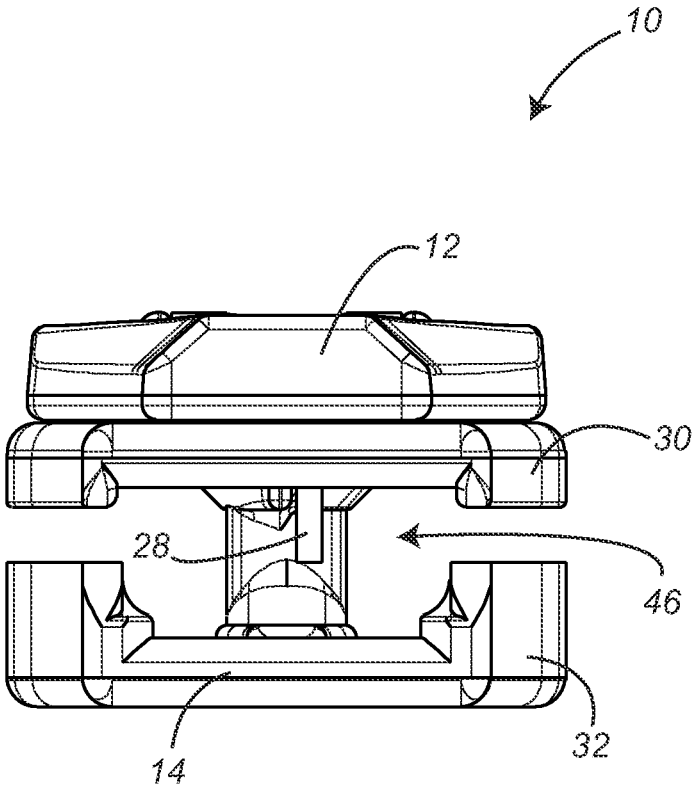
FIG. 4 is a rear plan view of the slider assembly of FIG. 1.
Figure 5:
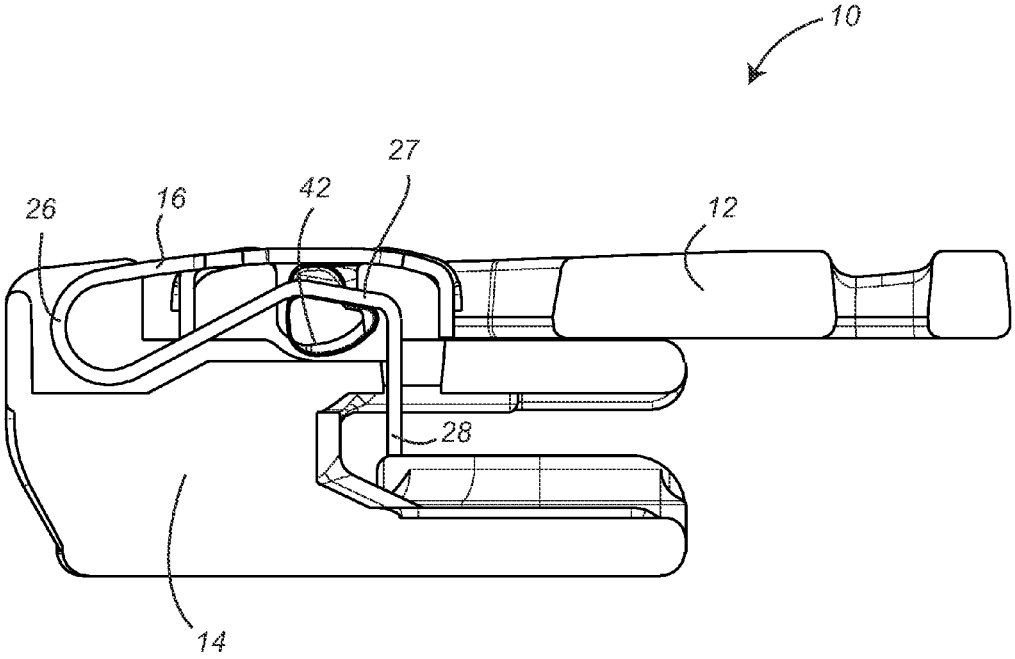
FIG. 5 is a cross sectional view of the slider assembly of FIG. 1, shown in the locked orientation.
Figure 6:
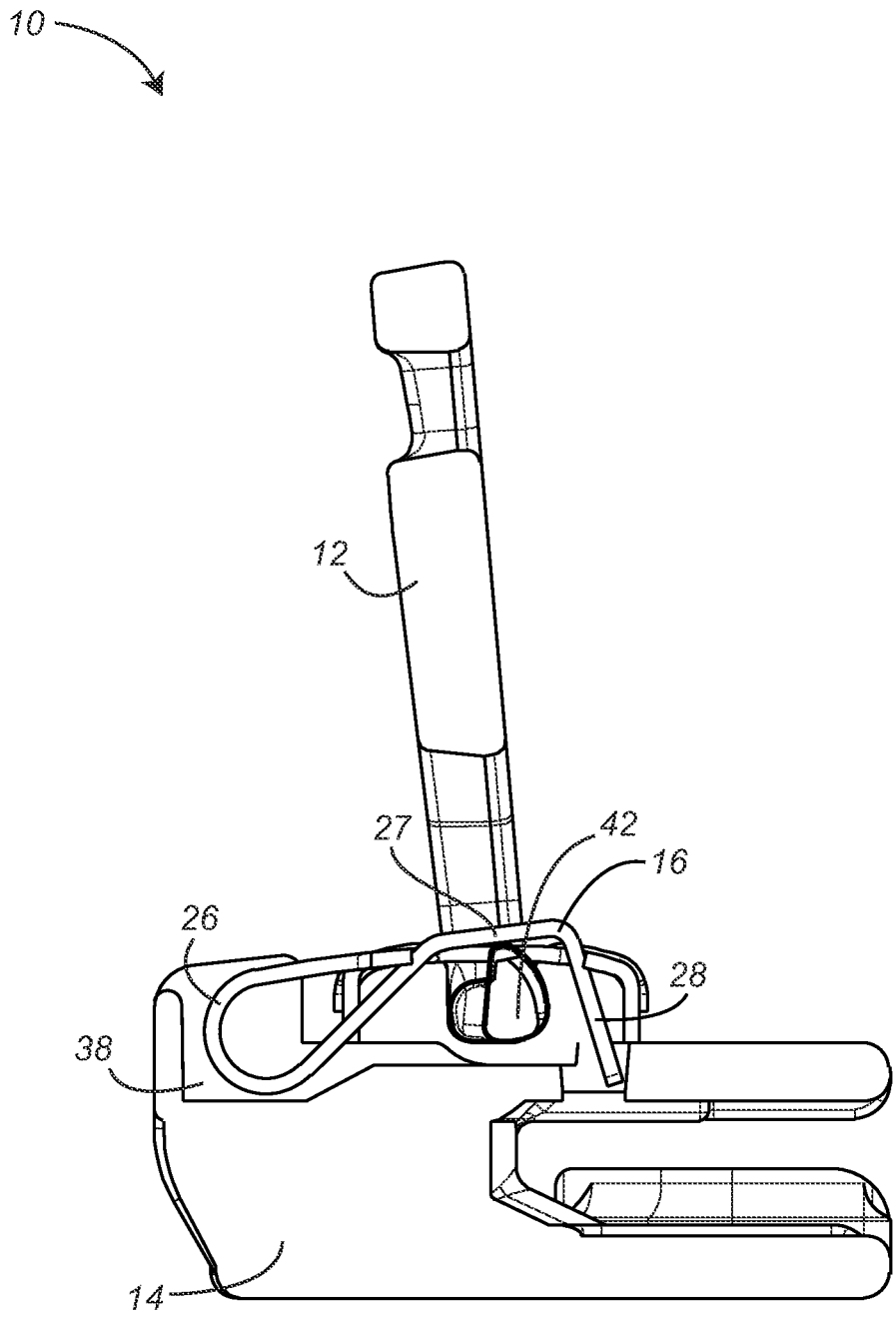
FIG. 6 is a cross sectional view of the slider assembly of FIG. 1, shown in the unlocked orientation.

Because pull tab 12 is pivotably connected to the slider body 14, pull tab can swing between a generally horizontal position, shown in FIG. 5 for example, and a generally vertical (raised) position, shown in FIG. 6 for example. As shown in FIG. 24, when the pull tab 12 is in the generally horizontal position, the nail portion 28 of the lock pin 16 engages with an element 44 of the tape. This engagement between the nail portion 28 and the element 44 restricts movement of the slider assembly 10 along the tape. Therefore, when the pull tab is in the generally horizontal position, the slider assembly is in the locked orientation.

Pull tab 12 includes a protrusion 42 that protrudes from the axis body of the pull tab 12. The protrusion 42 is positioned with respect to lock pin 16. In particular, the protrusion 42 is oriented to cooperate with the lock pin 16 when the pull tab 12 is pulled into the raised position (FIG. 6). Specifically, the protrusion 42 moves from a generally horizontal orientation within the slider assembly 10 to a generally vertical orientation. Such movement causes protrusion 42 to engage with the lower portion 29 of the lock pin 16, forcing lower portion 29 and the apex section 27 upward. As mentioned above, lower portion 29 is positioned below opening 18, so that, when lower portion 29 is forced upwards, lower portion 29 and the apex section 27 are received within opening 18. In this way, opening 18 prevents interference caused by raising the pull tab 12 as shown in FIG. 6 to its raised position, which in turn raises the lock pin 16.

As protrusion 42 raises lock pin 16, the nail portion 28 also raises, thus releasing the engagement between nail portion 28 and the element 44 (as shown in FIG. 25). Slider assembly 10 is now in the unlocked orientation and free to move along the tape.

Bent portion 26 is configured so that it stores energy as lower portion 29 of the lock pin 16 is raised by pull tab 12. In this way, when pull tab 12 is released, lock pin 16 has a tendency to spring back into its original position (moving slider assembly 10 from its unlocked orientation back into its locked orientation). Similarly, if pull tab 12 is not fully moved into its raised position, lock pin 16 has a tendency to spring back and urge pull tab 12 back to its generally horizontal position.

Because lock pin 16 includes an opening 18 through which apex section 27 of lower portion 29 can pass as lower portion 29 is raised by pull tab 12, the required amount of space between the pull tab 12 and the lock pin 16 is reduced and the overall height (thickness) of the slider assembly 10 is decreased. The opening 18 serves as a clearance area that prevents interference that would be caused by the raising of the apex section 27.

Numerous modifications of this invention may be made in the composition, application, manufacturing process and other aspects of this invention without departing from the objectives and spirit of the description above and in the Figures.

The invention claimed is:

1. A slider assembly having a locked orientation and an unlocked orientation, the slider assembly comprising:

(a) a slider body comprising a recess, a cavity, and a plurality of stoppers positioned along a top of the slider body, the plurality of stoppers each comprising a notch and an extension that extends upwardly from a top surface of the stopper and that extends in a forward and rearward direction beyond a pedestal of the stopper;

(b) a pull tab pivotably connected to the slider body, the pull tab having a first orientation and a second orientation; and (c) a lock pin positioned with respect to the top of the slider body, the lock pin comprising:

(i) a lower portion comprising an apex section and a nail portion extending from the apex section, wherein the nail portion extends through the cavity of the slider body and into a channel of the slider body when the slider assembly is in the locked orientation and wherein the nail portion does not project into the channel of the slider body when the slider assembly is in the unlocked orientation;

(ii) an upper portion having left and right sides that contact the plurality of stoppers and that partially define an opening positioned above the apex section of the lower portion, the upper portion also having a rear surface that extends downwardly from the left and right sides and that contacts the top of the slider body, wherein the apex section of the lower portion at least partially extends through the opening when the slider assembly is in the unlocked orientation;

(iii) a plurality of engagement portions that extend from the upper portion generally transverse to the left and right sides and that engage by snap fit engagement with the notches of the plurality of stoppers to secure the lock pin onto the slider body, wherein the plurality of engagement portions are positioned below the opening; and (iv) a bent portion joining the upper portion with the lower portion, wherein at least a part of the bent portion is received within the recess of the slider body, wherein movement of the pull tab from the first orientation to the second orientation moves the slider assembly from the locked orientation to the unlocked orientation.

2. The slider assembly of claim 1, wherein the pull tab further comprises a protrusion that cooperates with the lock pin when the pull tab is in the second orientation.

3. The slider assembly of claim 1, wherein edges of the right and left sides of the upper portion of the lock pin abut the extensions of the plurality of stoppers.

4. The slider assembly of claim 1, wherein the slider body further comprises a wall that surrounds the recess.

5. The slider assembly of claim 1, wherein the slider body is made of plastic.

6. The slider assembly of claim 1, wherein a portion of the pull tab is positioned between the top of the slider body and the lower portion of the lock pin.

7. The slider assembly of claim 1, wherein the lock pin extends generally perpendicular to the apex section of the lower portion when the slider assembly is in the locked orientation.

8. The slider assembly of claim 1, wherein the plurality of stoppers comprises four stoppers.

9. The slider assembly of claim 1, wherein the bent portion is generally U-shaped.

10. A lock pin configured to engage with a slider body, the lock pin comprising:

(i) a lower portion comprising an apex section and a nail portion extending from the apex section, wherein the nail portion is configured to extend through a cavity of the slider body and into a channel of the slider body;

(ii) an upper portion having left and right sides and a rear surface that partially define an opening positioned above the apex section of the lower portion, the rear surface extending downwardly from the left and right sides, and the upper portion also having a plurality of engagement portions that extend generally transverse to the left and right sides, that are positioned below the opening, and that are configured for snap fit engagement with a plurality of notches of the slider body to secure the lock pin onto the slider body; and (iii) a generally U-shaped bent portion joining the upper portion with the lower portion, wherein at least a part of the generally U-shaped bent portion is configured to be received within a recess of the slider body, wherein the plurality of engagement portions comprises four engagement portions.

11. The lock pin of claim 10, wherein the generally U-shaped bent portion projects outwardly from a front of the lower portion.

12. The lock pin of claim 10, wherein the apex section is generally planar.

13. A slider assembly having a locked orientation and an unlocked orientation, the slider assembly comprising:

(a) a slider body comprising a top wing and a bottom wing that are separated from one another by a channel:

(i) a plurality of stoppers positioned along the top wing of the slider body, each of the plurality of stoppers comprising a pedestal and an extension that extends upwardly from a top surface of the stopper and that extends beyond the pedestal of the stopper and that includes a notch;

(ii) a recess formed within a front of the slider body; and (iii) a cavity; and (b) a lock pin positioned with respect to the top wing of the slider body, the lock pin comprising:

(i) a lower portion having an apex section and a nail portion extending from the apex section, wherein the nail portion extends through the cavity of the slider body and projects into the channel of the slider body when the slider assembly is in the locked orientation and wherein the nail portion lifts with respect to the cavity when the slider assembly is in the unlocked orientation so that it does not project into the channel;

(ii) an upper portion having left and right sides that partially define an opening positioned above the apex section of the lower portion, wherein the left and right sides contact the plurality of stoppers of the slider body and wherein the apex section is at least partially received within the opening when the slider assembly is in the unlocked orientation;

(iii) a plurality of engagement portions that extend from the upper portion transversely to the left and right sides, wherein the plurality of engagement portions are positioned below the opening and engage by snap fit engagement with the notches of the plurality of stoppers to secure the lock pin onto the slider body; and (iv) a generally U-shaped bent portion joining the upper portion with the lower portion, wherein the generally U-shaped bent portion projects outwardly from a front of the lower portion and wherein at least a part of the generally U-shaped bent portion is received within the recess of the slider body.

14. The slider assembly of claim 13, wherein an edge of each of the left and right sides of the lock pin abuts the extension of the plurality of stoppers.

15. The slider assembly of claim 13, wherein the lock pin further comprises a rear surface that extends downwardly from the left and right sides of the upper portion and that contacts the top wing of the slider body.

16. The slider assembly of claim 13, wherein the slider body is made of plastic.

17. The slider assembly of claim 13, further comprising a pull tab that is retained within the assembly by the lock pin.

* * * * *